United States Patent [19]

Witte

[11] Patent Number: 4,513,794

[45] Date of Patent: Apr. 30, 1985

[54] WIRE FORMING MACHINE

[75] Inventor: Fritz Witte, Wendlingen, Fed. Rep. of Germany

[73] Assignee: Womako Maschinenkonstruktionen GmbH, Nürtingen, Fed. Rep. of Germany

[21] Appl. No.: 423,079

[22] Filed: Sep. 24, 1982

[30] Foreign Application Priority Data

Nov. 14, 1981 [DE] Fed. Rep. of Germany ..... 3145275

[51] Int. Cl.[3] ..... B21F 1/00

[52] U.S. Cl. ..... 140/105; 72/162

[58] Field of Search ..... 140/105; 72/162, 191

[56] References Cited

U.S. PATENT DOCUMENTS

| | | | |
|---|---|---|---|
| 2,097,193 | 10/1937 | Jacobs | 140/105 |
| 2,770,262 | 11/1956 | Gauci | 140/105 |
| 3,566,927 | 3/1971 | Adams | 72/191 |
| 3,869,900 | 3/1975 | Norman | 140/105 |
| 4,047,544 | 9/1977 | Seaborn et al. | 72/191 |

FOREIGN PATENT DOCUMENTS

| | | | |
|---|---|---|---|
| 1252616 | 10/1967 | Fed. Rep. of Germany | 140/105 |
| 2148915 | 5/1972 | Fed. Rep. of Germany . | |

*Primary Examiner*—Lowell A. Larson
*Assistant Examiner*—Linda McLaughlin
*Attorney, Agent, or Firm*—Peter K. Kontler

[57] ABSTRACT

A machine for converting straightened wire into an elongated undulate comb-like product wherein hairpin-shaped prongs alternate with webs which extend in the longitudinal direction of the product has two carriers which are rotatable about parallel axes and have neighboring end faces defining a forming channel. Each carrier supports a group of equidistant tools which are reciprocable in parallelism with and are equidistant from the axis of the respective carrier. The carriers are alternately indexed in opposite directions, and the wire is fed into the channel by a pivotable portion of a wire feeding unit so that it is alternately engaged by successive tools of the one and the other carrier. The tools are shifted into the channel before they engage the wire, they remain in engagement with the wire while the respective carriers dwell between successive indexing movements, and they are thereupon retracted from the channel not later than when the respective carriers are indexed again whereby the tools are automatically separated from the wire. Levers are provided to urge the wire against the tools in the channel.

24 Claims, 11 Drawing Figures

WIRE FORMING MACHINE

BACKGROUND OF THE INVENTION

The present invention relates to machines for converting straight or coiled wire into undulate wire, especially into a meandering wire which is ready to be converted into so-called Wire-O (trademark) binders for use in steno pads, note books, calendars, exercise books and analogous stationery products. More particularly, the invention relates to improvements in wire forming machines wherein a length of running straight or coiled wire can be converted into undulate wire of the type having hairpin-shaped sections or prongs alternating with straight sections or webs which connect the open ends of neighboring hairpin-shaped sections to each other and can be said to constitute the back of a substantially comb-like product.

Undulate products of the aforediscussed type are converted into binders by imparting to them a C-shaped or trough-shaped outline and by subdividing them into binder blanks of desired length. Such blanks are thereupon introduced into the perforations of stacks of superimposed sheets to hold the sheets together as soon as the blanks are closed by causing the tips of the prongs to come close to or to actually contact the webs i.e., by converting the substantially C-shaped blanks into substantially tubular binders. The perforations form a row along one edge of each stack and enable the sheets to pivot about the axis which is defined by the respective binder.

In accordance with a heretofore known proposal, a length of wire is converted into an undulate product by alternately looping the wire about successive pins or dogs of two rows of pins or dogs (hereinafter called pins) and by thereupon changing the distance between the two rows so that the wire is stretched and undergoes permanent deformation as a result of elongation beyond the elastic limit of its material, i.e., the pattern which is imparted by the two rows of pins is "frozen" into the resulting undulate product. The wire hugs the two rows of pins upon completion of the stretching operation to thus exhibit a number of prongs which alternate with the aforementioned webs. The pins of one row are configurated to form the webs, and the pins of the other row are configurated to form the tips of the prongs. Reference may be had to U.S. Pat. Nos. 3,691,808, 3,805,579, 4,047,544 and 4,165,767. A drawback of such apparatus is that the wire is likely to break when the operating speed is increased beyond a relatively low limit, namely, below a limit which must be exceeded if the machine is to satisfy the requirements of modern binder inserting units in production lines for the aforediscussed and similar stationery products.

It is also known to convert straight or coiled wire into an undulate product of the above-discussed character by resorting to machines which utilize orbiting interengaged forming tools followed by a second set of tools having wire shaping grooves and serving to impart to selected portions of undulate wire their final shape. Such wire forming machines are disclosed in U.S. Pat. Nos. 3,046,694 and 3,670,781. These machines also exhibit the drawback that the wire is subjected to very pronounced tensional stresses so that it is likely to break, especially when the speed of the machine is relatively high. Moreover, the tools of the second set are likely to come into strong frictional engagement with the material of the wire which is particularly undesirable when the wire contains a core and an outer layer surrounding the core. The outer layer is likely to be damaged, defaced or totally destroyed in response to strong frictional engagement with the tools of the second set.

It is further known to form meandering wire products in machines which utilize the aforediscussed two rows of pins, a mechanism which alternately loops the wire around successive pins of the two rows, and tongs which shape the wire in the regions of the pins so as to impart to the corresponding portions of the wire a desired shape, namely, to impart the final shape to the aforementioned webs and to the tips of the hairpin-shaped prongs. Reference may be had to U.S. Pat. Nos. 2,047,771 and 3,556,166. The output of such machines is relatively low so that their use in modern high-speed production lines for steno pads, exercise books and analogous stationery products is unwarranted.

German Offenlegungsschrift No. 2 148 915 proposes to provide the bolts of a link chain with wire forming pins and to change the mutual inclination of neighboring chain links during transport of the chain so that the distance between the neighboring pins changes. Such machine must include an additional apparatus which imparts to partially deformed wire its ultimate shape. The German publication proposes to use shaping tools in the form of worms whose deleterious effect is analogous to that of the aforementioned second set of tools in machines disclosed, for example, in U.S. Pat. No. 3,670,781, i.e., the worms are likely to damage, deface or destroy the outer layer of the wire or to exert an equally deleterious influence upon the surface of uncoated wire.

OBJECTS AND SUMMARY OF THE INVENTION

An object of the invention is to provide a novel and improved wire forming machine which can turn out undulate wire at a high rate and without adversely affecting the appearance of the product.

Another object of the invention is to provide the machine with novel and improved means for converting straight or coiled wire into undulate wire in a small area and by resort to a simple, rugged and compact wire forming mechanism.

A further object of the invention is to provide the machine with novel and improved means for moving the wire forming tools with reference to one another.

An additional object of the invention is to provide a novel and improved method of converting straight or coiled wire into an undulate product wherein hairpin-shaped sections alternate with straight sections.

Another object of the invention is to provide the machine with novel and improved means for converting straight wire into an undulate product in a single stage, i.e., without any need for secondary treatment of the once deformed wire.

Still another object of the invention is to provide novel and improved means for enabling the machine to turn out undulate wire products of any one of a wide variety of sizes and shapes.

The invention is embodied in a machine for converting a length of wire into an undulate product, especially into an elongated comb-like product wherein closely adjacent substantially hairpin-shaped prongs alternate with substantially straight webs extending in the longitudinal direction of the product. The machine comprises first and second rotary tool carriers defining a forming channel, wire deforming means including at least one first and at least one second wire deforming tool eccentrically mounted on the respective carrier, means for alternately indexing the first and second carriers in opposite directions so that the respective tools orbit along first and second endless paths which partially overlap each other in the channel, means for supplying wire into the channel so that the wire is alternately engaged and deformed by the first and second tools, and means for separating the thus deformed wire from the tools in the channel. The wire deforming means preferably comprises a set of first tools and a set of second tools, and such tools are equidistant from the axes of the respective carriers. Furthermore, the tools of each set are preferably equidistant from one another, as considered in the circumferential direction of the respective carrier, and the indexing means then includes means for rotating the carriers through angular distances corresponding to those between the neighboring tools of the respective sets. The number of first tools preferably equals the number of second tools. The axes of the two carriers are preferably parallel to each other.

The carriers are preferably formed with surfaces which flank the channel, and such surfaces are preferably flat and parallel to each other, at least in the regions of endless paths of the first and second tools, especially in the regions of overlap of the first and second paths.

The tools are preferably movable with reference to the respective carriers, preferably in parallelism with the axes of the respective carriers, and the machine then further comprises means for moving the tools relative to their carriers. Such moving means preferably constitutes the aforementioned separating means and can include means for introducing the tools into the channel prior to engagement of such tools with the wire and for retracting the tools from the channel upon completed bending of the wire by the tools, e.g., shortly before a carrier is indexed. The moving means can comprise stationary cams which are operative to move the tools in response to indexing of the respective carriers.

The machine can further comprise a pair of levers or other suitable means for urging the wire into engagement with the tools which extend into the channel. Such engagement preferably takes place during the intervals between successive indexing movements of the respective carriers. The means for displacing the urging means so as to move such urging means into and from engagement with that portion of the wire which is in contact with a tool in the channel can comprise continuously driven rotary cam means, and such cam means can be designed to pivot the aforementioned levers about axes which are parallel to the axes of the carriers.

Still further, the machine can comprise stationary rails or other suitable guide means which preferably extends into the channel and serves to guide the product along a predetermined path.

The indexing means preferably comprises a discrete indexing device for each carrier.

The wire supplying means can comprise or constitute a wire feeding unit which preferably includes a wire straightening device. Such wire feeding unit is preferably outwardly adjacent to the channel and can include a portion which is movable relative to the channel in synchronism with back-and-forth (e.g., up-and-down) movements of the wire in the channel as a result of engagement with the first and second tools. The feeding unit can include several groups of wire-engaging rolls including a first group which can constitute the aforementioned wire straightening device and a second group which can form part of the aforementioned movable portion of the feeding unit. The rolls of the first group are then located ahead of the rolls of the second group, as considered in the direction of advancement of wire toward and into the channel, and the rolls of the first and second groups are preferably disposed in two mutually inclined planes, preferably in planes which are at least substantially normal to one another. The axes of the rolls forming the second group are preferably normal to the aforementioned flat parallel surfaces of the carriers which flank the channel. The aforementioned portion of the wire feeding unit preferably further comprises a support for the rolls of the second group and a shaft or other suitable means mounting the support for pivotal movement about an axis which is at least substantially parallel to the axes of the rolls in the second group and preferably also to the axis of at least one carrier.

The tools are preferably designed in such a way that the outline of each tool of one of the two sets of tools conforms to (i.e., determines) the shape of a web and a portion of the outline of each tool of the other set of tools conforms to the shape of the tip of a prong.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
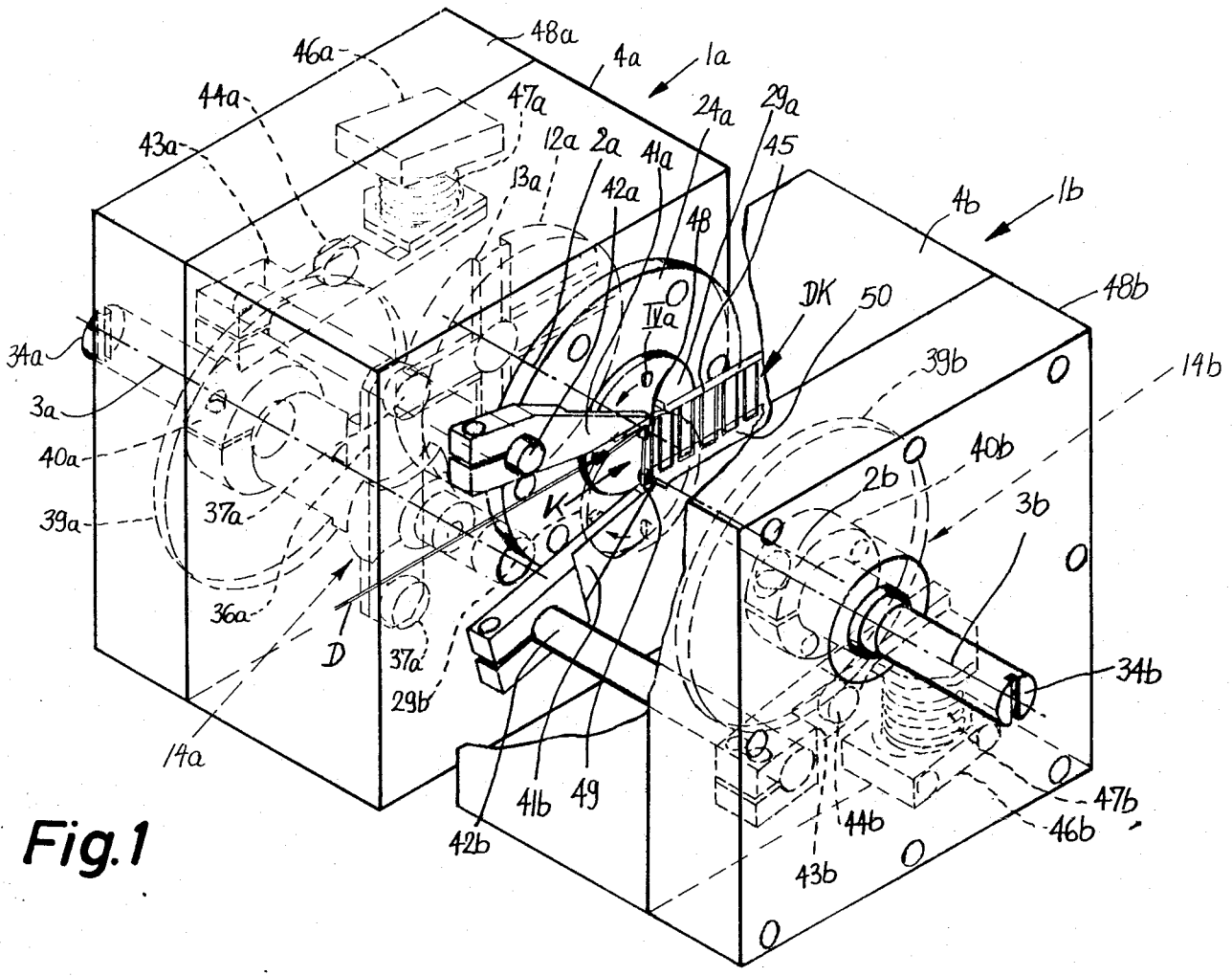
FIG. 1 is a somewhat diagrammatic perspective view of a portion of a wire forming machine which embodies the invention.

The wire forming machine of FIG. 1 includes two identical or practically identical assemblies of parts 1*a* and 1*b* which are assembled of similar or identical components and whose operation is based on the same principle. The assemblies 1*a* and 1*b* are disposed opposite one another in such a way that their wire bending or deforming tools face each other and are staggered relative to one another, as considered in the vertical direction, through distances corresponding to the length of prongs P (FIGS. 3*a* and 3*b*) on the finished product DK, i.e., through distances corresponding to that between the tip Z of a prong P and the nearest webs A.

Figure 2:
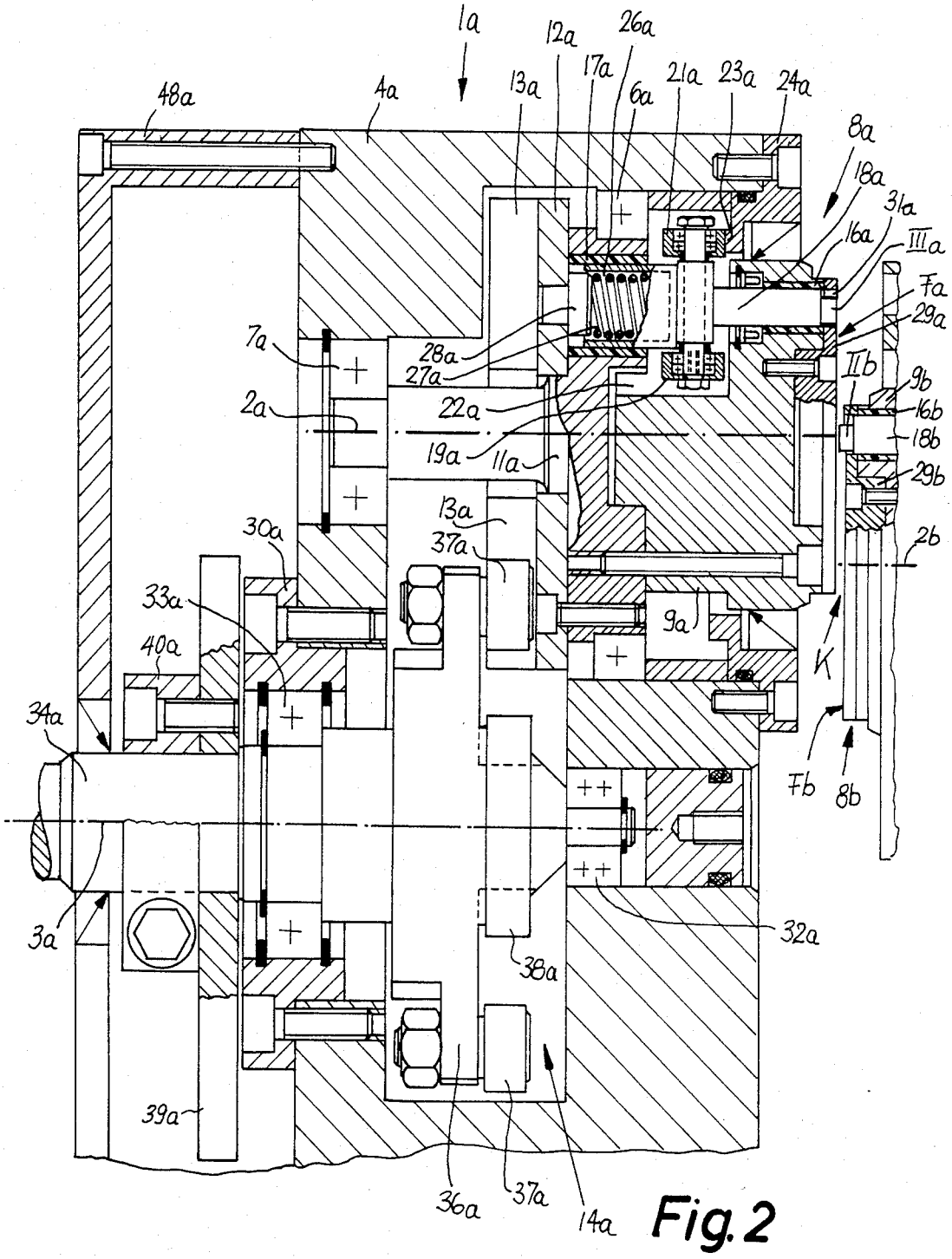
FIG. 2 is a composite sectional view of one half of the structure which is shown in FIG. 1.

The sectional view of FIG. 2 is taken through the assembly 1*a* in a composite plane which extends in part horizontally and includes an axis 2*a* (denoted by a phantom line) and in part vertically to include an axis 3*a* (also indicated by a phantom line).

The outlines or cross-sectional configurations of wire bending or deforming tools in the form of pins Ia, IIa, IIIa, IVa and Ib, IIb, IIIb, IVb can be seen in FIGS. 3*a* to 3*h*. Those pins which are shown in solid black assume their operative positions in which they extend into a forming channel K (note FIG. 2) disposed between the assemblies 1*a* and 1*b*. Those pins which are shown only by their outlines are held out of the operative positions, i.e., they do not extend into the forming channel K. The pins Ia to IVa are configurated to shape the webs A whereas the pins Ib to IVb are configurated to shape the tips Z of the hairpin-like prongs P of the finished product or comb DK.

The following description will deal with the assembly 1*a* with the understanding, however, that it also applies to the major part of the assembly 1*b*. Any differences between the assemblies 1*a* and 1*b* will be pointed out as the description proceeds. In order to avoid overcrowding of the drawing, FIG. 2 merely shows certain elements of the drive for various mobile parts, and several such elements are indicated by phantom lines.

The assembly 1*a* comprises a housing 4*a* forming part of a support for a rotary tool carrier 8*a* which is mounted in antifriction ball bearings 6*a* and 7*a*. The carrier 8*a* is assembled of two sections 9*a* and 11*a* which are held together by screws or analogous fasteners. The axis 2*a* is common to the sections 9*a* and 11*a* of the carrier 8*a* The section 11*a* is connected with the indexible wheel 12*a* of an indexing device here shown as a conventional geneva movement 14*a* which can rotate the carrier 8*a* in stepwise fashion. The movement 14*a* is not shown in full detail because its construction forms no part of the present invention. The wheel 12*a* has grooves 13*a* for the pins 37*a* of a driving member 36*a* of the geneva movement 14*a*.

Each of the sections 9*a* and 11*a* contains four sleeves 16*a* and 17*a* which are equidistant from the axis 2*a* and accommodate tool-moving elements in the form of pushers 18*a* which are equidistant from one another. Each of the pushers 18*a* is reciprocable or shiftable in parallelism with the axis 2*a* and the front end portions of such pushers are adjacent to the channel K and support the aforementioned bending or deforming pins Ia, IIa, IIIa, and IVa. Each of the pushers 18*a* further carries a guide roll 19*a* and a roller follower 21*a*. The guide rolls 19*a* extend into guide grooves 22*a* which are machined into the section 9*a* of the carrier 8*a* and are parallel to the axis 2*a*, i.e., the surfaces bounding the grooves 22*a* and the guide rolls 19*a* cooperate to hold the respective pushers 18*a* against rotation about their own axes. The roller followers 21 track a stationary reciprocating device in the form of a suitably configurated cam 23*a* forming part of or being secured to a cover 24*a*. The latter is affixed to the housing 4*a* by screws or the like and closes therein a bore for the carrier 8*a*. The roller followers 21*a* are biased against the cam 23*a* by coil springs 27*a* which are installed in the bores 26*a* of the respective pushers 18*a* and react against retainers 28*a* on the indexible wheel 12*a* of the geneva movement 14*a*.

The carrier 8*a* is provided with a lid 29*a* having a flat outer or end surface Fa and openings 31*a* for the pins Ia to IVa so that such pins can extend into the channel K. It will be noted that the channel K is disposed between the outer surfaces or end faces Fa and Fb of lids 29*a*, 29*b* of the respective carriers 8*a*, 8*b*. The surfaces Fa and Fb are parallel to one another.

The rear side of the housing 4*a* (namely, that side which faces away from the channel K) is connected with a bearing sleeve 30*a* for a continuously driven shaft 34*a* which rotates in ball bearings 32*a*, 33*a* and receives motion from a constantspeed motor or transmission, not shown. The shaft 34*a* drives the aforementioned driving member 36*a* which is a two-armed lever each arm of which carries a roller constituting the aforementioned pin 37*a*. The reference character 38*a* denotes a detent cam which cooperates with complementary cams (not specifically shown) on the indexible wheel 12*a* to prevent uncontrolled angular displacements of the wheel 12*a* when neither of the pins 37*a* extends into one of the grooves 13*a*. In view of the fact that the section of FIG. 2 is taken in a composite plane, the distance between the axes 2*a* and 3*a* of FIG. 2 appears to be greater than in the actual wire forming machine. This also applies for the parts which rotate about the axes 2*a* and 3*a*.

If desired, the geneva movements 14*a*, 14*b* for the carriers 8*a*, 8*b* can be replaced with electric stepping motors or with electrically controlled hydraulic motors, as long as such motors are capable of indexing the carriers 8*a* and 8*b* through angles of 90 degrees (because each carrier supports four tools).

The shaft 34*a* is rigid with a disc cam 39*a* which is secured thereto by a clamping ring 40*a*. This clamping ring surrounds the shaft 34*a* outwardly adjacent to the disc cam 39*a* and is secured to the latter by one or more screws, bolts or analogous fasteners. The purpose of the cam 39*a* is to displace a pivotable wire urging device in the form of a lever 41*a* which extends into the guide channel K (see particularly FIG. 1). The lever 41*a* is clampingly secured to one end portion of a shaft 42*a* which is journalled in the housing 4*a*. The other end portion of the shaft 42*a* is clampingly secured to a further lever 43*a* having a roller follower 44*a* which tracks the periphery of the disc cam 39*a*. A coil spring 47*a* reacts against a retaining block 46*a* of or in the housing 4*a* and biases the lever 43*a* so that the roller follower 44*a* bears against the cam 39*a*. A further cover 48*a* is secured to the housing 4*a* by screws or bolts and serves to confine the parts 39*a*, 40*a* at the rear side of the housing.

The free end portion of the lever 41*a* extends into the guide channel K and carries a hook-shaped wire engaging portion 48. The lever 41*b* of the assembly 1*b* also extends into the channel K; however, its free end portion does not carry a support but is merely provided with a wire engaging surface 49.

The guide channel K further accommodates portions of stationary elongated guide rails 45 and 50 for the comb DK.

The positions of the assemblies 1*a* and 1*b* with reference to each other are selected (i.e., these assemblies are integrated into the wire forming machine) in such a way that the axes 2*a*, 3*a* for the carrier 8*a* and shaft 34*a* are parallel with the axes 2*b* and 3*b* for the carrier 8*b* and shaft 34*b*, and that the distance between the axes 2*a*, 2*b* equals the length of prongs P of the product DK. Such distance is measured at right angles to the direction of transport of the product or comb DK from the channel K. In other words, the carriers 8*a* and 8*b* are eccentric to one another and the extent of their mutual eccentricity matches the length of a prong P. When the carriers 8*a* and 8*b* are indexed about their respective axes 2*a* and 2*b*, the tools Ia to IVa and Ib to IVb orbit along discrete endless circular paths which partially overlap each other (note FIGS. 3*a* to 3*h*).

All such parts of the assembly 1*b* which are shown in FIGS. 1 to 3*h* but are not specifically referred to herein are denoted by reference numerals matching those used for the parts of the assembly 1*a* but each followed by the character b.

Figure 4:
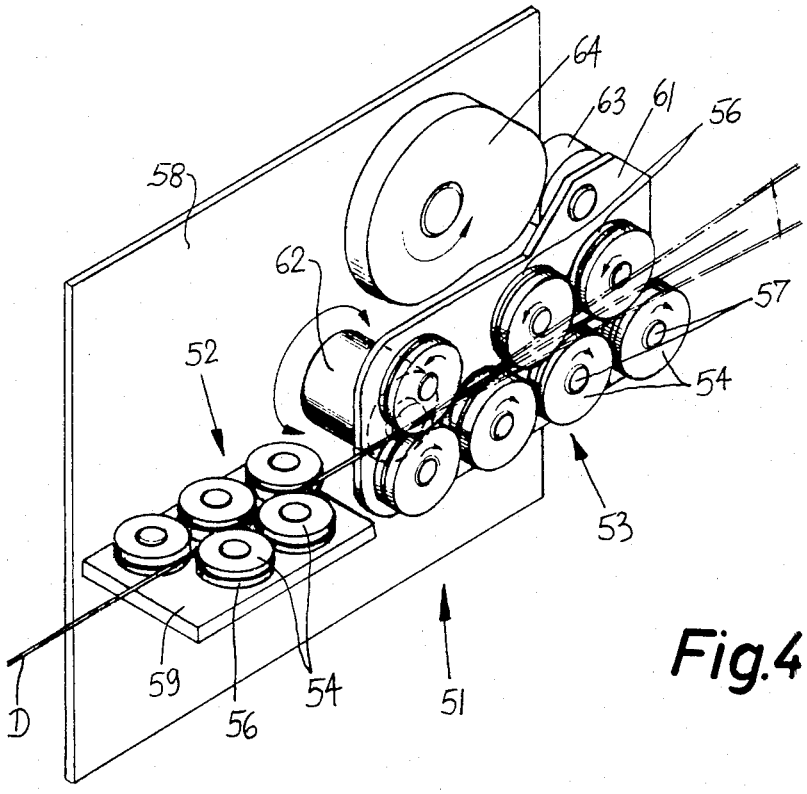
FIG. 4 is a perspective view of a wire feeding unit which can be used to supply wire to the structure of FIG. 1.

The assemblies 1*a* and 1*b* receive wire D from a wire feeding unit 51 which is shown in FIG. 4. This feeding unit 51 constitutes a wire straightener and includes two groups (52 and 53) of rolls 54. The groups 52 and 53 are disposed one behind the other, as considered in the direction of advancement of the wire D toward the channel K, and their rolls 54 have peripheral grooves 56 for the wire. The rolls 54 of the first group 52 are disposed in a first plane which is normal to the plane of the rolls 54 in the group 53. The axes 57 of rolls 54 in the second group 53, which is nearer to the channel K than the group 52, are normal to the channel, i.e., they are parallel to the axes 2*a* and 2*b*.

The rolls 54 of the group 52 are mounted on a bracket 59 which is secured to the frame 58 of the wire forming machine. The rolls 54 of the second group 53 are mounted on a common support in the form of a plate 61 which is turnable about the axis of a shaft 62. The latter is mounted in the machine frame 58. The plate 61 can be said to constitute an arm or lever which further carries a roller follower 63 tracking a continuously driven disc cam 64 which is mounted in the frame 58. The cam 64 is configurated and driven in such a way that the plate 61 is pivoted twice up and down during each revolution of the shafts 34*a* and 34*b*. In other words, that portion of the wire feeding unit 51 which includes the rolls 54 of the second group 53 shares those (back-and-forth) movements of the wire D which are imparted to the wire by the pins Ia to IVa and Ib to IVb.

The mode of operation is as follows:

The geneva movements 14*a* and 14*b* are connected with a common drive in such a way that the carriers 8*a*, 8*b* are indexed in opposite directions and out of phase, i.e., the carrier 8*b* is indexed in a clockwise direction through 90 degrees while the carrier 8*a* is at a standstill, and the carrier 8*a* is indexed through 90 degrees in a counterclockwise direction while the carrier 8*b* is at a standstill. During indexing of the carriers 8*a* and 8*b*, the roller followers 21*a* and 21*b* respectively track the cams 23*a* and 23*b* and thereby change the axial positions of the corresponding pushers 18*a* and 18*b*. Consequently, the pins Ia to IVa and Ib to IVb are moved seriatim into the channel K to deform the wire D therein and thereupon move seriatim out of the channel upon completion of the respective bending or deforming step. As already mentioned above, FIGS. 3*a* to 3*h* illustrate in solid black those pins which actually extend into the channel K whereas the other pins (outside of the channel K) are denoted only by their outlines.

The cams 39*a* and 39*b* pivot the corresponding levers 41*a* and 41*b* up and down in such a way that (as can be seen in FIGS. 3*a* to 3*h*) the hooked portion 48 of the lever 41*a* cooperates with the pins Ib to IVb, and the surface 49 of the lever 41*b* cooperates with the pins Ia to IVa. As also mentioned above, the rolls 54 of the second group 53 swing up and down about the axis of the shaft 62 in synchronism with the deforming action of the pins Ia to IVa and Ib to IVb upon the wire D. Such wire is pulled through the feeding unit by successive pins Ia to IVa and Ib to IVb.

Figure 3A:
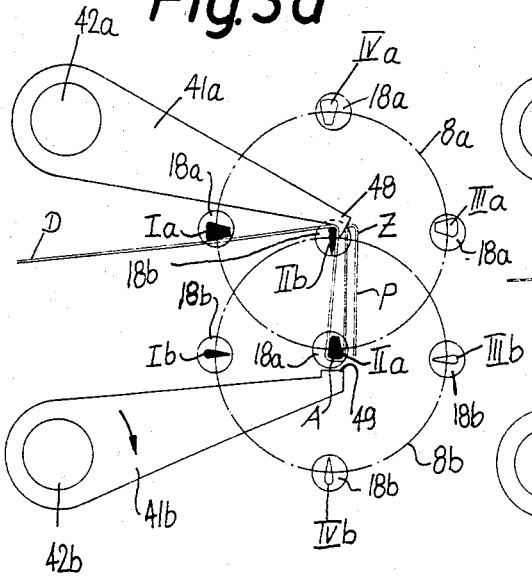
FIGS. 3*a* to 3*h* illustrate various stages of operation of the improved machine.

FIG. 3*a* illustrates the positions of the pins Ia to IVa, Ib to IVb and levers 41*a*, 41*b* immediately prior to indexing of the carrier 8*a*. The lever 41*b* is located in its lower end position (after completion of pivotal movement in a clockwise direction, as viewed in FIG. 3*a*) so that its surface 49 has ceased to urge the adjacent web A against the pin IIa. The wire D has been engaged by the pin Ia during the preceding indexing of the carrier 8*a*, namely, while the wire D was being deformed by the pin IIb. The hooked portion 48 of the lever 41*a* holds the wire D against the pin IIb. The rolls 54 of the wire feeding unit 51 ensure that the wire D is maintained under requisite tension which is desirable and necessary for the forming or bending operation.

Figure 3B:
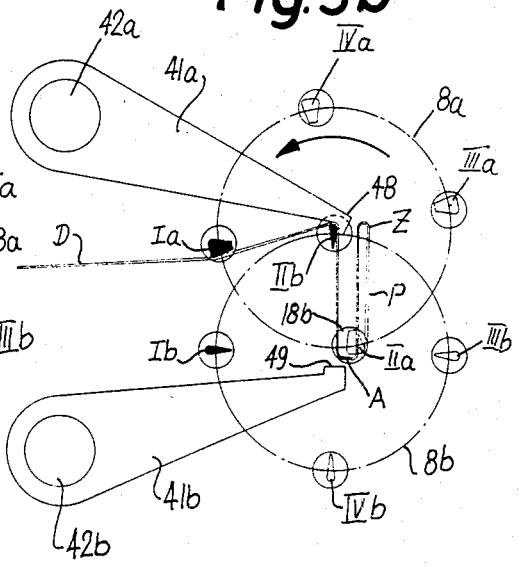

FIG. 3*b* illustrates the initial stage of the wire bending or deforming action of the pin Ia. This Figure further shows that the corresponding pusher 18*b* retracts the associated pin IIa from the channel K during the initial stage of indexing of the pin Ia into deforming engagement with the wire D.

Figure 3C:
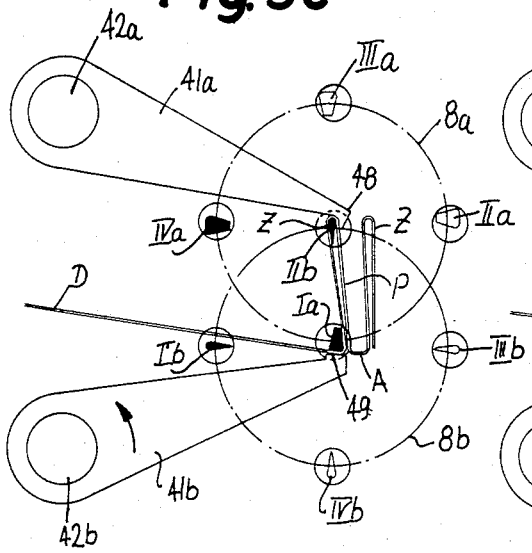

FIG. 3*c* shows the parts in or adjacent to the channel K upon completion of indexing of the carrier 8*a* through 90 degrees, namely, after the pin Ia has completed the formation of a prong P by bending the wire D about the pin IIb. The tip Z of such prong P surrounds the pin IIb. The lever 41*b* has been pivoted to its upper end position (in a counterclockwise direction, as viewed in FIG. 3*c*) so that its surface 49 urges the wire D against the pin Ia.

Figure 3D:
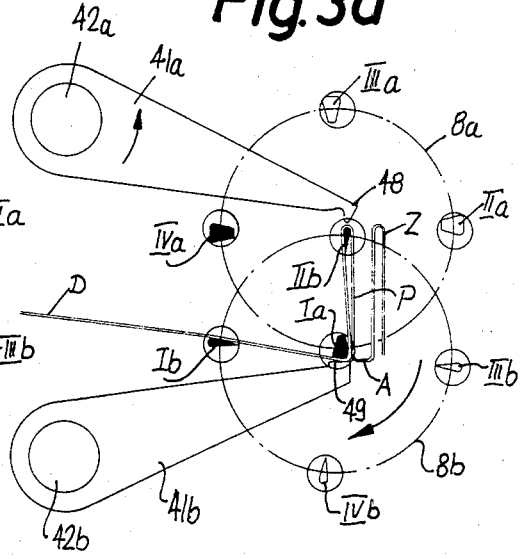

FIG. 3*d* illustrates the initial stage of the indexing movement of the carrier 8*b* which begins upon completion of the preceding indexing movement of the carrier 8*a*. The lever 41*a* is pivoted to its upper end position (in a counterclockwise direction, as viewed in FIG. 3*d*) so that its hooked portion 48 provides room for movement of the pin IIb in a clockwise direction, as viewed in FIG. 3*d*. At first, the pin IIb remains in the operative position (in which it extends into the channel K) so that it straightens out the freshly formed prong P (such prong was slightly inclined with reference to the preceding prong during that stage of the forming operation which is shown in FIG. 3*c*).

Figure 3E:
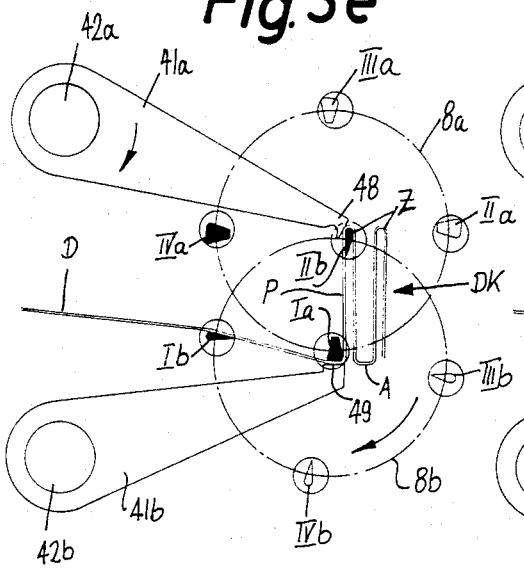

The stage of operation which is shown in FIG. 3*e* is reached when the pin IIb completes the straightening or alinement of the freshly formed prong P with the preceding prong. The lever 41*a* has reassumed its lower end position (after a pivotal movement in a clockwise direction, as viewed in FIG. 3*e*) and the pin Ib has been advanced into contact with the wire D.

Figure 3F:
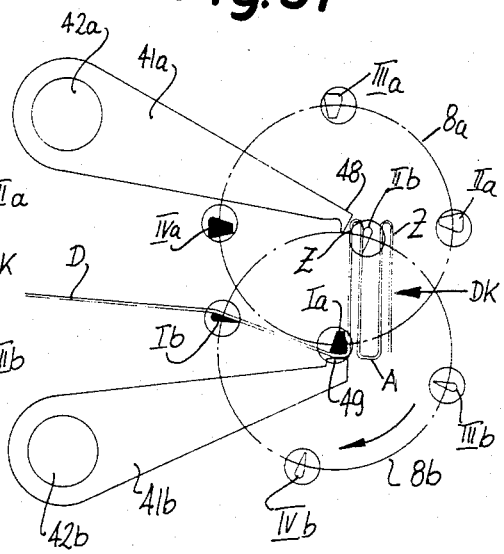

The next stage of operation is illustrated in FIG. 3*f*. The pin IIb has been retracted from the channel K after completion of the aforediscussed straightening or alignment of the last-formed prong P with the preceding prong.

Figure 3G:
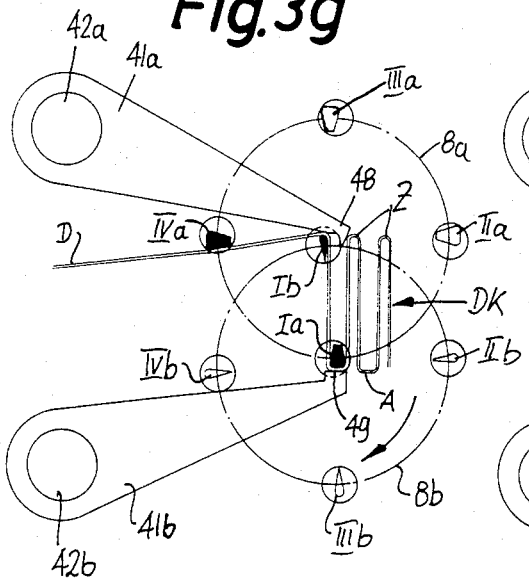
Figure 3H:
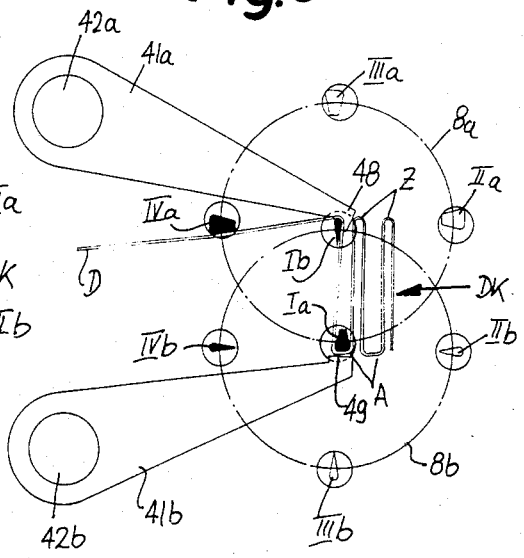

FIG. 3*g* illustrates the pins in positions they assume shortly prior to completion of indexing of the carrier 8*b*, and FIG. 3*h* shows the parts in the positions they assume when the indexing of the carrier 8*b* is completed. The pin Ib urges the wire D against the hooked portion 48 of the lever 41*a*, the wire D contacts the pin IVa, and the machine forms a fresh web A of the comb DK.

FIGS. 3*c*, 3*d* and 3*h* show that the wire D is initially bent to an extent greater than necessary for the formation of the comb DK. This is desirable in order to take into consideration the innate elasticity of the wire, i.e., the wire recoils slightly after it is disengaged from the pins and from the parts 48, 49 so that it then assumes the optimum shape for the formation of predictably configurated webs A, prongs P and tips Z. Such "overbending" or excessive deformation of the wire D renders it possible to dispense with the normally required stretching operation through the medium of the pins and/or with a secondary treatment in an auxiliary or additional apparatus in order to ensure that the configuration of the final product will meet the desired norms.

The comb DK is automatically advanced in and beyond the channel K as a result of indexing of the carriers 8*a* and 8*b*. Such comb is guided by the stationary rails 45 and 50 so that it is reliably held against any undesirable stray movements.

An important advantage of the improved wire forming machine is that the formation of prongs P and webs A is completed in response to simple indexing of the carriers 8*a* and 8*b* in opposite directions. In other words, successive webs A and prongs P are formed by the simple expedient of advancing the pins Ia to IVa and Ib to IVb along two discrete partly overlapping endless paths in such a way that the pins Ia to IVa are idle while the pins Ib to IVb are in motion and vice versa. In other words, there is no need to subject the increments of wire D to an intermittent stretching action and/or to subject successive increments of the comb DK to a secondary treatment which is needed in accordance with numerous heretofore known proposals. The elimination of stretching reduces the likelihood of breakage of the wire D, and the elimination of (i.e., the absence of the need for) any secondary treatment reduces the likelihood of damage to the surface of the wire D, especially to a coating if the nature of the wire is such that its core is surrounded by a layer of protective or appearance-enhancing material.

Another important advantage of the improved wire forming machine is its compactness and relative simplicity. This is due to the fact that the pins Ia to IVa and Ib to IVb perform a simultaneous bending and forming operation. The simplicity contributes to a surprisingly high output of the improved machine because the carriers 8*a* and 8*b* can be alternately indexed at a very high frequency.

As mentioned above, the axes 2*a* and 3*a* are preferably parallel to the axes 2*b* and 3*b*. This is desirable and advantageous because the channel K between the flat parallel surfaces Fa and Fb of the lids 29*a* and 29*b* is ideally suited for proper guidance of the wire D toward the bending and forming station as well as for proper guidance of the finished product DK from the forming station and on to storage or to the next processing station, e.g., to a station where the flat product DK is converted into a C-shaped product and is subdivided into blanks of requisite length for conversion into tubular binders for stacks of paper sheets or the like. The provision of the aforementioned lids 29*a* and 29*b* with parallel surfaces Fa and Fb is desirable and advantageous on the additional ground that the improved machine need not be equipped with separate stripping means which is indispensable in conventional machines and serves to remove the looped portions of wire from the pins. The need for stripping means is obviated due to the provision of reciprocable pushers 18*a* and 18*b* which can introduce the respective pins Ia to IVa and Ib to IVb into and retract such pins from the channel K at required intervals under the action of relatively simple stationary cams (23*a* and 23*b*) in response to indexing of the carriers 8*a* 8*b*. The configuration of cam faces on the cams 23*a* and 23*b* can be readily selected in such a way that a pin which has completed a bending and forming step is retracted from the channel K and is returned into such channel in good time prior to renewed movement into contact with the wire D.

The levers 41*a* and 41*b* constitute an optional but highly desirable and advantageous feature of the improved wire forming machine. Thus, these levers cooperate with the pins Ia to IVa and Ib to IVb in the channel K to ensure that the shape and orientation of each web A and each prong P corresponds to a desired or optimum shape and orientation. As explained above in connection with FIGS. 3*a* to 3*h*, the arrangement is preferably such that the hooked portion 48 of the lever 41*a* bears against the tip Z of a freshly formed prong which is looped around the pin Ib, IIb, IIIb or IVb while such pin extends into the channel K upon completion of indexing of the carrier 8*b* (i.e., while the geneva movement 14*a* indexes the carrier 8*a*), and that the surface 49 of the lever 41*b* bears against a freshly formed web A while the corresponding pin Ia, IIa, IIIa or IVa extends into the channel K upon completed indexing of the carrier 8*a* (i.e., while the geneva movement 14*b* indexes the carrier 8*b*). While the illustrated levers 41*a* and 41*b* constitute but one form of means which can be used to hold the wire D against the respective pins during the periods of dwell of such pins in the channel K subsequent to completion of indexing of the respective carriers, they are preferred at this time because their movements can be readily controlled and synchronized by relatively simple and compact means.

It is further within the purview of the invention to provide a single indexing mechanism which is common to the carriers 8*a*, 8*b* and is capable of alternately indexing these carriers in the aforedescribed manner. The provision of two discrete indexing means (such as the aforedescribed geneva movements 14*a* and 14*b*) is preferred at this time because this reduces the inertia of moving parts, i.e., the carrier 8*a* or 8*b* and the means which indexes such carrier can be rapidly accelerated to a desired speed and rapidly decelerated to zero speed because the combined mass of a carrier and the indexing means therefor is relatively small. As mentioned above, the illustrated geneva movements constitute but one form of means which can be used in the improved wire forming machine to convert an uninterrupted rotary movement of a driving element (such as the shafts 34*a* or 34*b*) into an intermittent indexing movement of the respective carrier.

The provision of stationary cams (23*a* and 23*b*) which effect reciprocatory movements of the pushers 18*a* and 18*b* for the respective sets of pins Ia to IVa and Ib to IVb also contributes to compactness and higher output of the improved wire forming machine because the mass of parts (pushers 18*a*, 18*b*) which must be set in motion to introduce the pins into or to withdraw the pins from the channel K is very small.

Stepwise bending of the wire D in response to alternative engagement with the pins Ia to IVa and Ib to IVb could impart to the wire an undesirable vibratory movement which is eliminated or reduced to an acceptable value by the feeding unit 51 of FIG. 4. The mounting of the plate 61 for the rolls 54 of the second group 53 for pivotal movement about the axis of the shaft 62, so that the plate 61 pivots in a plane which is parallel to the surfaces Fa and Fb, ensures that the increments of wire D advancing from the group 53 toward and into the channel K can swing up or down in dependency upon whether the carrier 8*a* is indexed while the carrier 8*b* is idle, or vice versa. Thus, the plate 61 can pivot clockwise, as viewed in FIG. 4, when the carrier 8*a* is indexed in a counterclockwise direction to move the pin Ia, IIa, IIIa or IVa into deforming engagement with the oncoming wire, and the plate 61 is indexed in a counterclockwise direction, as viewed in FIG. 4, when the carrier 8*b* is indexed clockwise to move the pin Ib, IIb, IIIb or IVb into engagement with the oncoming increment of the wire D.

The number of pins on the carriers 8*a*, 8*b* can be reduced to one, two or three, or increased beyond four. The indexing means for the carriers is then adjusted accordingly so as to index the carriers through angles of 360 degrees, 180 degrees, 120 degrees or less than 90 degrees.

As a rule, the wire D is drawn from a barrel wherein it is stored in the form of convolutions, i.e., such wire can stand at least some straightening prior to introduction into the channel K. This is achieved by the rolls 54 of the first group 52 in the feeding unit 51 of FIG. 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for converting a continuous length of wire into an undulate product, especially into an elongated comb-like product wherein closely adjacent substantially hairpin-shaped prongs alternate with substantially straight webs extending in the longiduinal direction of the product, comprising a support; first and second rotary tool carriers mounted in said support, defining a forming channel and being indexible about discrete first and second axes, said carriers having surfaces flanking said channel; wire deforming means including first and second sets of wire deforming tools eccentrically and movably mounted on the respective carriers and being equidistant from the respective axes as well as from one another, as considered in the circumferential directions of the respective carriers; means for alternately indexing said first and second carriers in opposite directions about the respective axes so that the respective tools orbit along first and second endless paths which partially overlap each other in said channel, said indexing means being mounted in said support; means for supplying wire to said channel and into the range of said tools so that the wire is alternately engaged and deformed by said first and second tools; means for separating the thus deformed wire from the tools in said channel; means for moving said tools with reference to the respective carriers including means for introducing said tools into said channel prior to engagement of such tools with the wire and for retracting the tools from said channel upon completed bending of the wire by such tools, said separating means and said moving means being mounted in said support; and mobile wire urging means cooperating with said tools for maintaining the wire in contact with the tools in said channel during the intervals between successive indexing movements of the respective carrier.

2. The machine of claim 1, wherein said indexing means include means for rotating said carriers through angular distances corresponding to those between the neighboring tools of the respective sets.

3. The machine of claim 2, wherein the number of said first tools equals the number of said second tools.

4. The machine of claim 1, wherein the axes of said carriers are parallel to each other.

5. The machine of claim 1, wherein said surfaces are at least substantially parallel to each other, at least in the regions of endless paths of said tools.

6. The machine of claim 1, wherein said moving means constitutes said separating means.

7. The machine of claim 6, further comprising displacing means for moving said urging means into and from engagement with the wire which is in contact with the tool in said channel.

8. The machine of claim 7, wherein said urging means comprises first and second levers which are pivotable about axes at least substantially parallel to the axes of the respective carriers.

9. The machine of claim 7, wherein said displacing means comprises continuously driven rotary cam means.

10. The machine of claim 1, further comprising guide means extending into said channel and arranged to guide the product along a predetermined path.

11. The machine of claim 10, wherein said guide means comprises stationary rails.

12. The machine of claim 1, wherein said indexing means comprises a discrete indexing device for each of said carriers.

13. The machine of claim 1, wherein each of said tools is reciprocable in at least substantial parallelism with the axis of the respective carrier.

14. The machine of claim 13, wherein said moving means comprises means for reciprocating said tools relative to the respective carriers, said reciprocating means including stationary cam means operative to move the tools in response to indexing of the respective carriers.

15. The machine of claim 1, wherein said wire supplying means includes a wire straightening device.

16. The machine of claim 1, wherein said wire supplying means comprises a wire feeding unit outwardly adjacent to said channel and including a portion movable relative to the channel in synchronism with back-and-forth movements of the wire in said channel as a result of engagement with said first and second tools.

17. The machine of claim 16, wherein said feeding unit comprises several groups of wire-engaging rolls including a first group constituting a wire straightening device and a second group forming part of said movable portion of said feeding unit.

18. The machine of claim 17, wherein the rolls of said first group are located ahead of the rolls of said second group, as considered in the direction of advancement of wire toward said channel.

19. The machine of claim 17, wherein the rolls of said first and second groups are disposed in two mutually inclined planes.

20. The machine of claim 19, wherein said planes are normal to each other.

21. The machine of claim 17, wherein said surfaces are at least substantially parallel to each other and the axes of rolls in said second group are at least substantially normal to such surfaces.

22. The machine of claim 17, wherein said portion of said wire feeding unit further includes a support for the rolls of said second group and means for mounting said support for pivotal movement about an axis which is at least substantially parallel to the axes of rolls in said second group.

23. The machine of claim 22, wherein the axis of said mounting means is at least substantially parallel to the axis of at least one of said carriers.

24. The machine of claim 1, wherein a portion of the outline of one of said tools conforms to the shape of a web and a portion of the outline of the other of said tools conforms to the shape of the tip of a prong.

* * * * *